US007407159B2

(12) United States Patent
Tazika

(10) Patent No.: US 7,407,159 B2
(45) Date of Patent: Aug. 5, 2008

(54) MULTIPURPOSE TRAY

(75) Inventor: Kiyoshi Tazika, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 479 days.

(21) Appl. No.: 11/158,629

(22) Filed: Jun. 22, 2005

(65) Prior Publication Data

US 2005/0285330 A1 Dec. 29, 2005

(30) Foreign Application Priority Data

Jun. 28, 2004 (JP) ..... 2004-189924

(51) Int. Cl.
*B65H 1/00* (2006.01)
*B65H 1/26* (2006.01)

(52) U.S. Cl. ..... 271/171; 271/157; 271/162

(58) Field of Classification Search ..... 271/157, 271/149, 9.01, 9.09, 171, 162; 399/393; 400/624, 628; 248/298.1, 286.1
See application file for complete search history.

(56) References Cited

U.S. PATENT DOCUMENTS

| | | | | |
|---|---|---|---|---|
| 6,729,616 | B2 * | 5/2004 | Chen | 271/213 |
| 7,070,350 | B2 * | 7/2006 | Inokuchi et al. | 400/680 |
| 2003/0001331 | A1 * | 1/2003 | Shyu | 271/171 |
| 2003/0141652 | A1 * | 7/2003 | Guddanti et al. | 271/171 |
| 2003/0178764 | A1 * | 9/2003 | Hasegawa | 271/171 |

FOREIGN PATENT DOCUMENTS

| | | |
|---|---|---|
| JP | 62-34534 | 2/1987 |
| JP | 04-072255 | 3/1992 |
| JP | 07-242341 | 9/1995 |
| JP | 11-222322 | 8/1999 |

OTHER PUBLICATIONS

Patent Abstracts of Japan, Publication No. 07-242341, Publication Date: Sep. 19, 1995, 1 page.
Patent Abstracts of Japan, Publication No. 04-072255, Publication Date: Mar. 6, 1992, 1 page.
Partial Translation of Japanese Utility Model Laying-Open No. 62-34534, Date of Laying-Open: Feb. 28, 1987, 1 page.
Patent Abstracts of Japan, Publication No. 11-222322, Publication Date: Aug. 17, 1999, 1 page.

* cited by examiner

*Primary Examiner*—Patrick Mackey
*Assistant Examiner*—Patrick D Cicchino
(74) *Attorney, Agent, or Firm*—Osha Liang LLP

(57) ABSTRACT

A multipurpose tray includes a first tray having a first loading surface and a second tray provided to be freely slidable along a predetermined direction with respect to the first tray. The second tray has a second loading surface with an area continuous to the first loading surface changing according to its slide movement. The first tray is provided with a first lever opening and the second tray is provided with a second lever opening with a changing distance L from the first lever opening along a direction orthogonal to the predetermined direction. The multipurpose tray further includes a lever having one end guided by the first lever opening and the other end guided by the second lever opening, and a sheet pressing part provided at the one end of the lever and regulating the sheet position in the direction orthogonal to the predetermined direction. With this configuration, usability of the multipurpose tray can be improved while it can be made sufficiently small.

4 Claims, 4 Drawing Sheets

MULTIPURPOSE TRAY

BACKGROUND OF THE INVENTION

1. Field of the Invention

The present invention generally relates to a multipurpose tray, and more specifically, to a multipurpose tray where a plurality of types of sheets of paper and the like are loaded and the sheets are supplied to a printer.

2. Description of the Background Art

A printer is provided with a tray called a "multipurpose tray" in addition to a standard tray to accommodate a regular size sheet. The multipurpose tray is utilized when an irregular size sheet that the standard tray cannot accommodate is used or when a sheet is manually fed, and a plurality of types of sheets having different dimensions are loaded thereto.

As a technique related to such a multipurpose tray, for example, Japanese Patent Laying-Open No. 07-242341 discloses a sheet cassette that can easily align the edge faces of sheets to improve sheet feeding performance and versatility even when a different size sheet is accommodated. FIG. 7 is a perspective view showing the sheet cassette disclosed in Japanese Patent Laying-Open No. 07-242341.

Referring to FIG. 7, the sheet cassette includes a chassis 218 of the sheet cassette, and a rear edge regulating plate 225 and a width regulating plate 226 that are provided slidably on the surface of chassis 218. On the surface of chassis 218, a first guide groove 220 and a second guide groove 221 that extend in the same track are formed spaced apart from each other. Width regulating plate 226 is provided with first and second positioning pins protruding toward the surface of chassis 218, and the first and second positioning pins fit into first and second guide grooves 220 and 221, respectively. When rear edge regulating plate 225 is moved in a direction Y in FIG. 7, width regulating plate 226 is moved in a direction X in FIG. 7, being guided by first and second guide grooves 220 and 221.

Further, Japanese Patent Laying-Open No. 04-072255 discloses a sheet feeding device to perform width alignment and preparation of a recording sheet accurately and quickly. Japanese Utility Model Laying-Open No. 62-034534 discloses an extension guide mechanism of a document set stage where a width determining plate and an extension guide are linked to each other. In addition, Japanese Patent Laying-Open No. 11-222322 discloses a sheet carrying device which allows smooth and continuous movement of a sheet guide by simple operation and provides high reliability and cost reduction. In the devices disclosed in these publications, a tray which slides in the sheet feeding direction and a member that regulates the width direction of sheets are linked by a rack and pinion structure.

Since the multipurpose tray is used for manual feeding of a sheet and the like, generally, it is configured to have a structure that is normally accommodated inside a printer body and is drawn out of the printer body when used. Accordingly, the multipurpose tray needs to be designed small such that it can be accommodated inside the printer body. However, when the multipurpose tray is made smaller, dimensions of the tray are also made smaller, in which case a sufficient area for holding sheets cannot be ensured. Thus, when a large-size sheet is loaded, the tray cannot support it.

Accordingly, in the devices disclosed in the above publications, in order to handle different size sheets, there are provided a tray that slides in the sheet feeding direction and a member that slides in the sheet width direction to perform width alignment of the sheets. However, when the mechanism disclosed in the publications is provided in the multipurpose tray to ensure a sufficient length of the tray, the tray will be a large and complicated configuration. On the other hand, the devices disclosed in the publications use a configuration in which the tray that slides in the sheet feeding direction and the member performing width alignment of sheets are linked. Thus, it is also important for the multipurpose tray to eliminate complexity of operation to improve usability.

SUMMARY OF THE INVENTION

An object of the present invention is to solve the above-described problems and provide a multipurpose tray that is made sufficiently small and excellent in usability.

A multipurpose tray according to one aspect of the present invention includes a first tray having a first loading surface with a sheet loaded on the first loading surface being transported in a predetermined direction, and a second tray provided to be freely slidable along the predetermined direction with respect to the first tray. The second tray has a second loading surface having an area continuous to the first loading surface changing in accordance with slide movement of the second tray. The first tray is provided with a first lever opening that penetrates the first loading surface. The second tray is provided with a second lever opening having a changing distance from the first lever opening along a direction orthogonal to the predetermined direction. The multipurpose tray further includes a lever having one end guided by the first lever opening and the other end guided by the second lever opening, and a sheet pressing part that is provided at the one end and regulates the sheet position in the direction orthogonal to the predetermined direction on the first loading surface. When the sheet pressing part is moved along the first lever opening in accordance with the sheet size, the second tray slides with respect to the first tray via the lever.

The first tray is provided with a sheet abutting part that is positioned opposite to the sheet pressing part with the sheet loaded on the first loading surface therebetween and where the sheet is abutted. The first tray is connected to a sheet supplying part where the sheet is supplied from the first loading surface. At positions equal in distance from the sheet abutting part in the direction orthogonal to the predetermined direction, one of the first and second openings includes a first part that extends in the direction orthogonal to the predetermined direction. The first lever opening includes a second part that extends to have an increased distance from the sheet supplying part as it becomes farther away from the sheet abutting part.

In the thus configured multipurpose tray, the first and second lever openings where the one end and the other end of the lever are guided, respectively, are formed such that the distance from each other changes along the direction orthogonal to the predetermined direction (hereinafter also referred to as a sheet width direction). Accordingly, when the sheet pressing part is moved in the sheet width direction, the amount of change of the distance between the first and second lever openings is converted to the amount of slide movement of the second tray so that the second tray can automatically slide along the predetermined direction in which the sheet is transported (hereinafter also referred to as a sheet feeding direction). Thus, it is not necessary for a user to move the sheet pressing part and the second tray separately in accordance with the sheet size, improving usability of the multipurpose tray. Further, the amount of change of the distance between the first and second lever openings is appropriately set so that a sufficient amount of slide movement of the second tray can be ensured. Thus, it is possible to provide a multipurpose tray in a compact configuration that can handle a large size sheet.

Either the first or second lever opening includes the first part. Accordingly, the load when a user moves the sheet pressing part in the sheet width direction can be reduced. Thus, operability of the multipurpose tray can be improved.

Further, the first lever opening includes the second part. Accordingly, the sheet pressing part can be moved in a direction away from the sheet supplying part in accordance with a larger sheet size. Thus, the sheet can be pressed in a position closer to the center position of the sheet, so that the sheet position can be appropriately regulated in the sheet width direction.

The multipurpose tray according to another aspect of the present invention includes a first tray having a first loading surface with a sheet loaded on the first loading surface being transported in the predetermined direction, and a second tray provided to be freely slidable along a predetermined direction with respect to the first tray. The second tray has a second loading surface having an area continuous to the first loading surface changing in accordance with slide movement of the second tray. The first tray is provided with a first lever opening that penetrates the first loading surface and the second tray is provided with a second lever opening having a changing distance from the first lever opening along a direction orthogonal to the predetermined direction. The multipurpose tray further includes a lever having one end guided by the first lever opening and the other end guided by the second lever opening, and a sheet pressing part that is provided at the one end and regulates the sheet position in the direction orthogonal to the predetermined direction on the first loading surface. When the sheet pressing part is moved along the first lever opening in accordance with the sheet size, the second tray slides with respect to the first tray via the lever.

Preferably, the first tray is provided with a sheet abutting part that is positioned opposite to the sheet pressing part with the sheet loaded on the first loading surface therebetween and where the sheet is abutted. At positions equal in distance from the sheet abutting part in the direction orthogonal to the predetermined direction, one of the first and second openings includes a first part that extends in the direction orthogonal to the predetermined direction.

Preferably, the first tray is provided with a sheet abutting part that is positioned opposite to the sheet pressing part with the sheet loaded on the first loading surface therebetween and where the sheet is abutted. The first tray is connected to a sheet supplying part where the sheet is supplied from the first loading surface. The first lever opening includes a second part that extends to have an increased distance from the sheet supplying part as it becomes farther away from the sheet abutting part.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
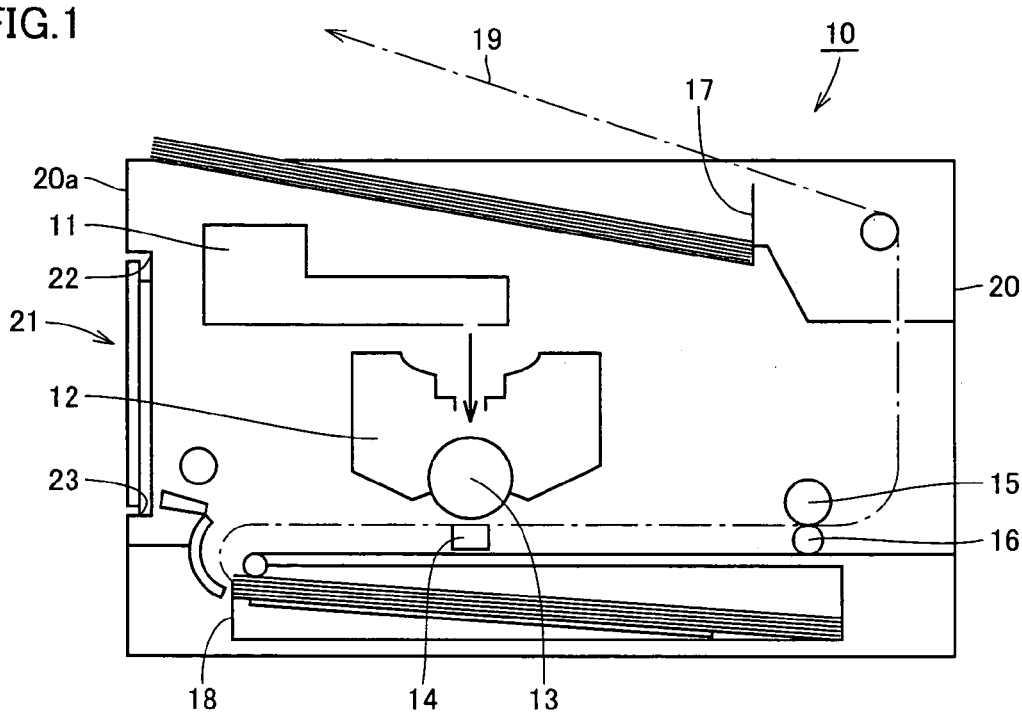
FIG. 1 schematically shows a laser printer to which a multipurpose tray in a first embodiment of the present invention is applied.

Embodiments of the present invention will now be described referring to the drawings.

First Embodiment

Referring to FIG. 1, a laser printer 10 includes a cover 20 having a front cover 20*a*, a multipurpose tray 21 provided at front cover 20*a* via a hinge 23 to be freely opened and closed, a standard tray 18 provided close to the bottom within cover 20*a* and loaded with sheets of a regular size such as A4 size, A3 size or the like, and a sheet discharging tray 17 provided at a top face of cover 20 and receiving a printed sheet. In FIG. 1, an arrow 19 shows the route which a sheet supplied from standard tray 18 follows until it reaches sheet discharging tray 17.

Within cover 20, positioned on the route shown by arrow 19 are a photosensitive body 13 and a transfer device 14 which transfers a toner image formed on photosensitive body 13 to the surface of a sheet while pressing the sheet against photosensitive body 13. At a position adjacent to photosensitive body 13, a process unit 12 is provided which accommodates a development device, toner, a toner transport mechanism and the like. On the opposite side of process unit 12 from photosensitive body 13, a laser unit 11 is provided which emits a laser beam toward photosensitive body 13. Further, within cover 20, a heat roll 15 and a pressure roll 16 that constitute a fixing device are provided on the route shown by arrow 19. A sheet sent from transfer device 14 passes through the fixing device so that the toner image transformed to the surface of the sheet is fixed.

Figure 2:
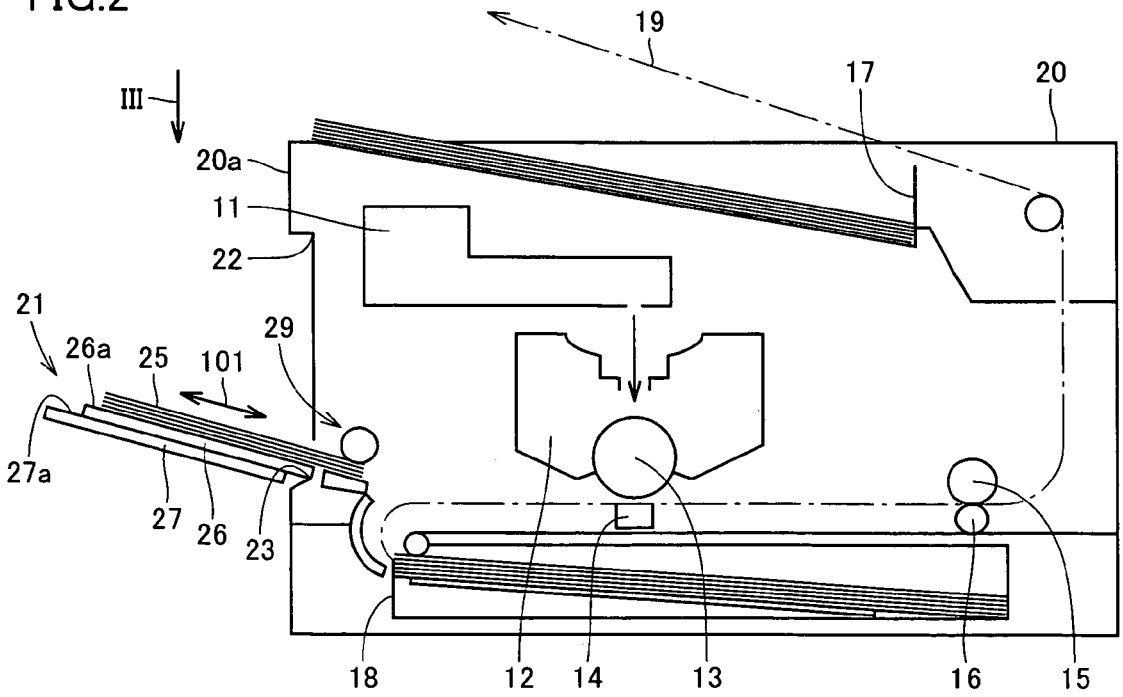
FIG. 2 schematically shows a state in which the multipurpose tray of the laser printer shown in FIG. 1 is opened.

Referring to FIGS. 1 and 2, multipurpose tray 21 is normally in a closed state and accommodated in an accommodating part 22 formed at front cover 20*a*. Multipurpose tray 21 is used when an irregular size sheet such as an envelope or a post card is used or when a sheet is manually fed, and in this case, it is opened from front cover 20*a*.

Multipurpose tray 21 includes a tray 26 having a loading surface 26*a* where a sheet 25 is loaded, and a tray 27 having a loading surface 27*a* continuous to loading surface 26*a*. Multipurpose tray 21 is connected to a sheet supplying part 29 provided within cover 20. Sheet 25 loaded on loading surface 26*a* is supplied to sheet supplying unit 29 along the direction shown by an arrow 101, and then sent from sheet supplying part 29 onto the route shown by arrow 19 where photosensitive body 13 and transfer device 14 are disposed. Tray 27 is provided to be freely slidable along the sheet feeding direction shown by arrow 101 with respect to tray 26. When a small size sheet 25 such as an envelope or the like is loaded on multipurpose tray 21 or when multipurpose tray 21 is closed, trays 26 and 27 shown in the FIG. 1 are overlapped to the greatest extent. When the sheet size is large, tray 27 is drawn out from tray 26 and the area of loading surface 27*a* continuous to loading surface 26*a* is made larger for use.

Figure 3:
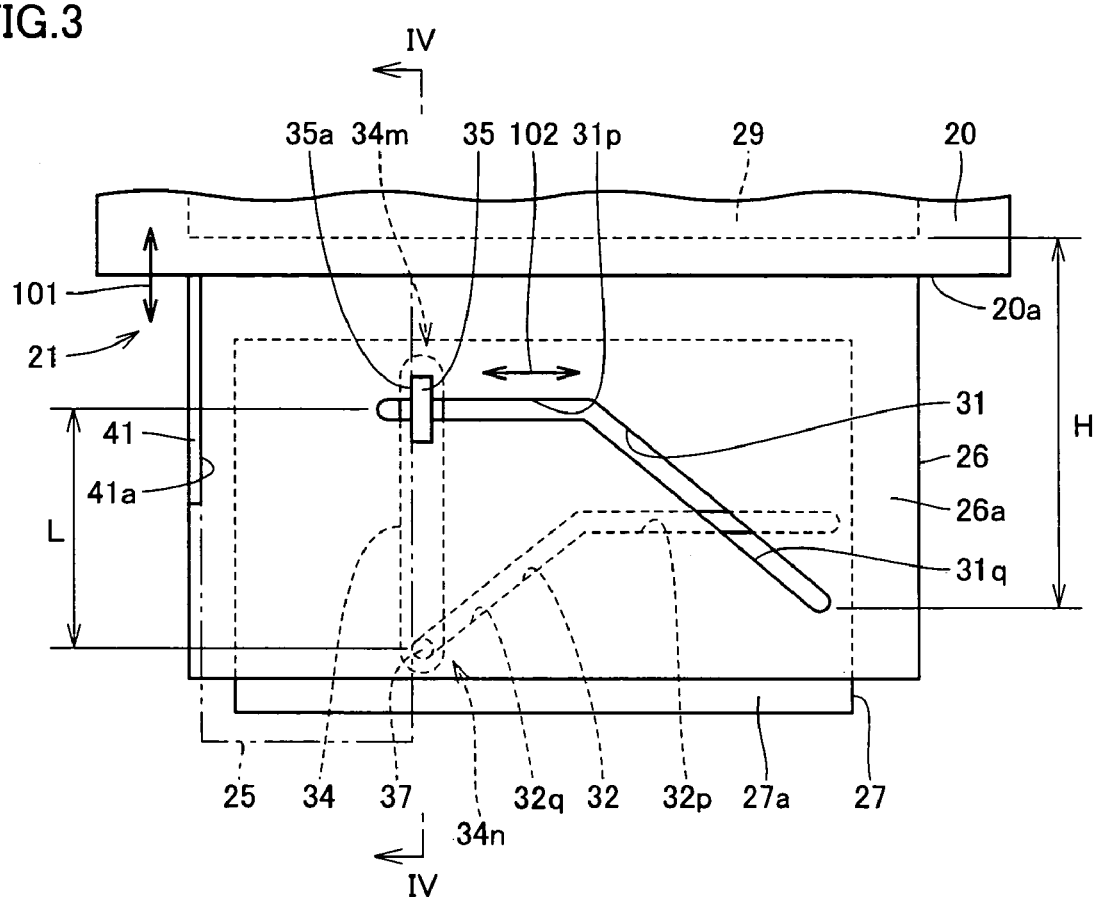
FIG. 3 is a top view of the multipurpose tray as seen from the arrow III in FIG. 2.
Figure 4:
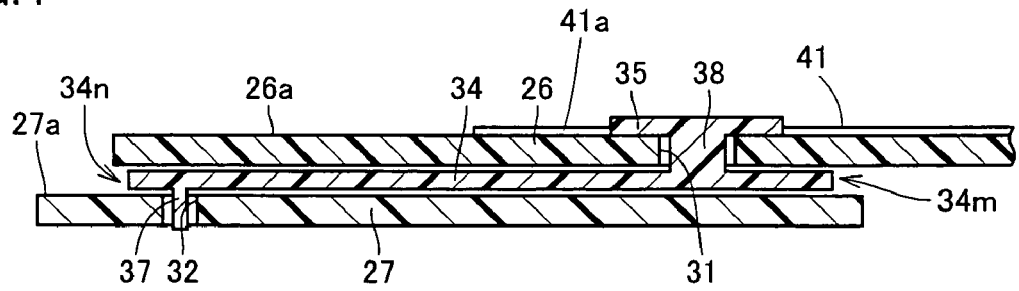
FIG. 4 is a cross sectional view of the multipurpose tray taken along the line IV-IV in FIG. 3.

Referring to FIGS. 3 and 4, tray 26 is provided with a sheet abutting part 41 positioned at a side edge of loading surface 26*a*. Sheet abutting part 41 has an abutting surface 41*a* that is erected from loading surface 26*a* at the right angle and where the edge face in the sheet width direction of sheet 25 is abutted.

Tray 26 is provided with a lever opening 31 penetrating loading surface 26*a* and tray 27 is provided with a lever opening 32 penetrating loading surface 27*a*. Lever openings 31 and 32 are formed such that a distance L between lever openings 31 and 32 changes along the sheet width direction of sheet 25 orthogonal to the sheet feeding direction (the direction shown by arrow 102).

More specifically, lever opening 31 has a linear part 31*p* extending in the sheet width direction of sheet 25 and an inclined part 31*q* continuous from linear part 31*p* and extending to have an increased distance H from sheet supplying part 29 as it becomes farther away from sheet abutting part 41. Lever opening 32 has an inclined part 32*q* extending to have a decreased distance from sheet supplying part 29 as it becomes farther away from sheet abutting part 41 and a linear part 32*p* continuous from inclined part 32*q* and extending in the sheet width direction of sheet 25. Linear part 31*p* and inclined part 32*q* are provided in a section where their distances from sheet abutting part 41 are equal, and inclined part 31*q* and linear part 32*p* are provided in a section where their distances from sheet abutting part 41 are equal. That is to say, lever openings 31 and 32 are formed such that one of them extends in the sheet width direction of sheet 25 at any positions where their distances from sheet abutting part 41 are equal.

With this configuration, in the section where linear part 31*p* and inclined part 32*q* are formed, inclined part 32*q* extends in a direction approaching linear part 31*p*, so that distance L reduces as they become farther away from sheet abutting part 41. In the section where inclined part 31*q* and linear part 32*p* are formed, inclined part 31*q* extends in a direction approaching linear part 32*p*, so that distance L reduces as they become farther away from sheet abutting part 41 (it is to be noted that although there is a section where the positional relation of lever openings 31 and 32 in the sheet feeding direction reverses in FIG. 3, it is assumed that distance L takes a negative value in the section).

Between trays 26 and 27, a lever 34 is provided which extends in the sheet feeding direction and has one end 34*m* and another end 34*n* on the opposite ends of the extending direction. Lever 34 is provided with a pin-like part 38 positioned at one end 34*m* and inserted into lever opening 31. At the end of pin-like part 38, a sheet pressing part 35 is further provided which protrudes over loading surface 26*a*. Sheet pressing part 35 has a position aligning surface 35*a* that is erected from loading surface 26*a* at the right angle and presses the edge face of sheet 25 in the sheet width direction. Sheet 25 is secured between an abutting surface 41*a* of sheet abutting part 41 and a position aligning surface 35*a* of sheet pressing part 35 so that its position in the sheet width direction is correctly aligned.

Lever 34 is further provided with a pin-like part 37 positioned at other end 34*n* and inserted into lever opening 32. With this configuration, lever 34 is moved in the sheet width direction of sheet 25 with one end 34*m* and other end 34*n* guided by lever openings 31 and 32, respectively.

Figure 5:
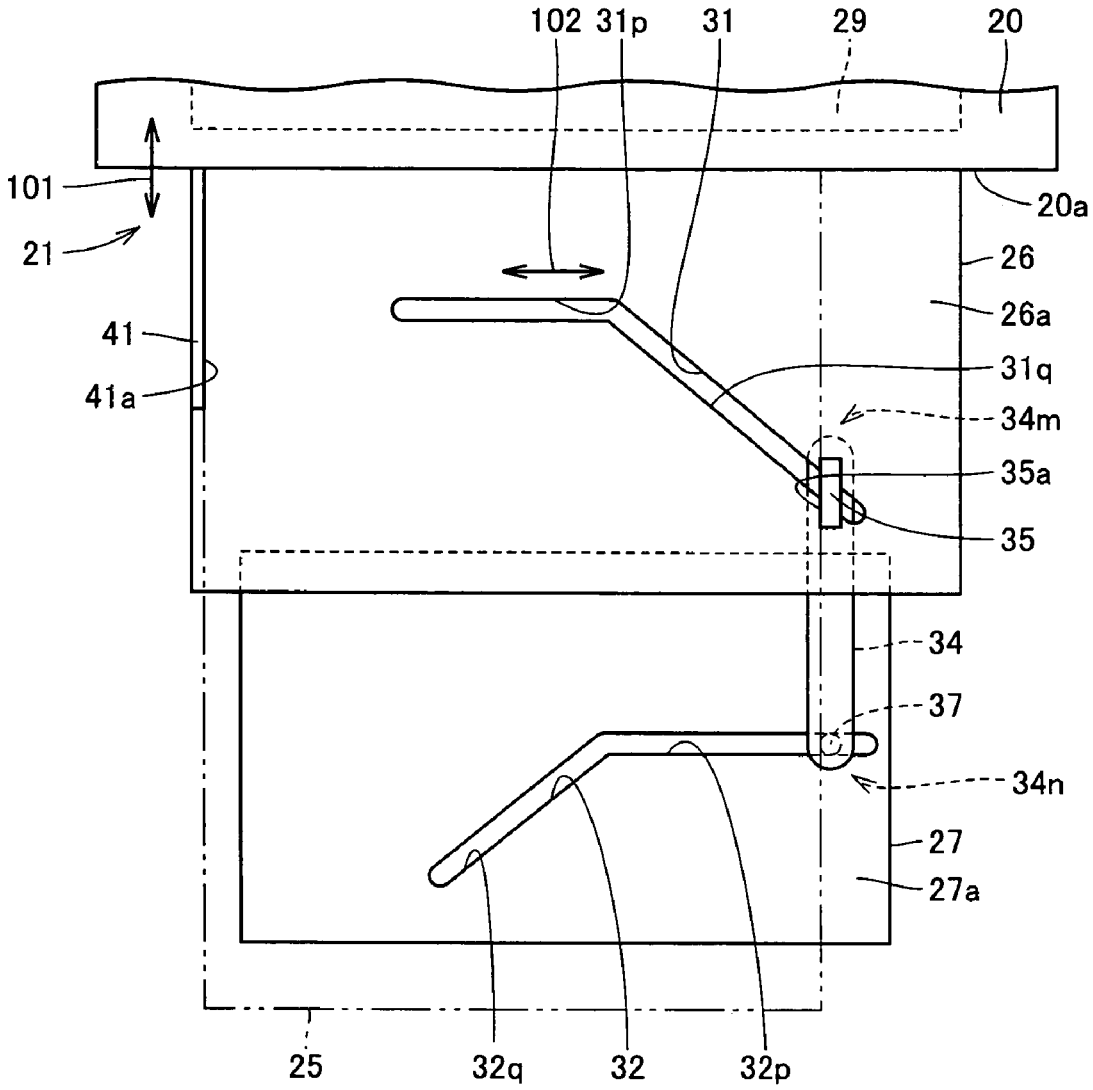
FIG. 5 is a top view showing a state in which a tray of the multipurpose tray is drawn out.

Referring to FIG. 5, if a large sheet 25 of A4 size or the like is loaded on multipurpose tray 21, sheet pressing part 35 is moved along lever opening 31 in accordance with the sheet width. At this time, as sheet pressing part 35 is made farther away from sheet abutting part 41, distance L between lever openings 31 and 32 is reduced with the movement of lever 34. Thus, tray 27 slides along the sheet feeding direction as pushed out by lever 34, increasing the area of loading surface 27*a* continuous to loading surface 26*a*.

With sheet pressing part 35 in any position, either one end 34*m* or other end 34*n* of lever 34 is guided by linear part 31*p* or 32*p* extending in the sheet width direction. Resistance caused between lever 34 and the lever opening is reduced at the side guided by the linear part, so that sheet pressing part 35 can always be moved smoothly in multipurpose tray 21 of the present embodiment. At inclined part 31*q*, sheet pressing part 35 moves in a direction away from sheet supplying part 29 as it becomes farther away from sheet abutting part 41. Thus, sheet pressing part 35 can press sheet 25 at a position closer to its center in accordance with the size of sheet 25.

Multipurpose tray 21 in the first embodiment of the present invention includes tray 26 as a first tray having loading surface 26*a* as a first loading surface with sheet 25 loaded on loading surface 26*a* being transported in the predetermined direction (in the direction shown by arrow 101), and tray 27 as a second tray provided to be freely slidable along the predetermined direction with respect to tray 26. Tray 27 has loading surface 27*a* with an area continuous to loading surface 26*a* changing in accordance with slide movement of the second tray. Tray 26 is provided with lever opening 31 as a first lever opening penetrating loading surface 26*a* and tray 27 is provided with lever opening 32 having a changing distance from lever opening 31 along the direction orthogonal to the predetermined direction (the direction shown by arrow 102). Multipurpose tray 21 further includes lever 34 having one end 34*m* guided by lever opening 31 and other end 34*n* guided by lever opening 32, and sheet pressing part 35 provided at one end 34*m* and regulating the sheet position in a direction orthogonal to the predetermined direction on loading surface 26*a*. When sheet pressing part 35 is moved along lever opening 31 in accordance with the sheet size, tray 27 slides with respect to tray 26 via lever 34.

Tray 26 is provided with sheet abutting part 41 positioned opposite to sheet pressing part 35 with sheet 25 loaded on loading surface 26*a* therebetween and where sheet 25 is abutted. Tray 26 is connected to sheet supplying part 29 where sheet 25 is supplied from loading surface 26*a*. At positions equal in distance from sheet abutting part 41 in the direction orthogonal to the predetermined direction, one of lever opening 31 and lever opening 32 includes linear part 31*p* or 32*p* as a first part extending in the direction orthogonal to the predetermined direction. Lever opening 31 includes inclined part 31*q* as a second part extending to have increased distance H from sheet supplying part 29 as it becomes farther away from sheet abutting part 41.

It is to be noted that although multipurpose tray 21 applied to laser printer 10 is explained in the present embodiment, the present invention is not limited there to and multipurpose tray 21 can be applied to various printers such as an ink jet printer and a heat transfer printer.

With thus configured multipurpose tray 21 in the first embodiment of the present invention, a user can make tray 27 slide to an appropriate position matching the sheet length of sheet 25 by just moving sheet pressing part 35 in accordance with the sheet width of sheet 25. Accordingly, it is not necessary to operate sheet pressing part 35 and tray 27 separately, eliminating complexity of operation. In multipurpose tray 21, tray 27 can be moved corresponding to the amount of change of distance L along the sheet width direction. Accordingly, larger sheet 25 can be handled by making the amount of slide movement of tray 27 larger. Thus, multipurpose tray 21 can easily be made smaller to be accommodated in accommodating part 22.

Second Embodiment

Figure 6:
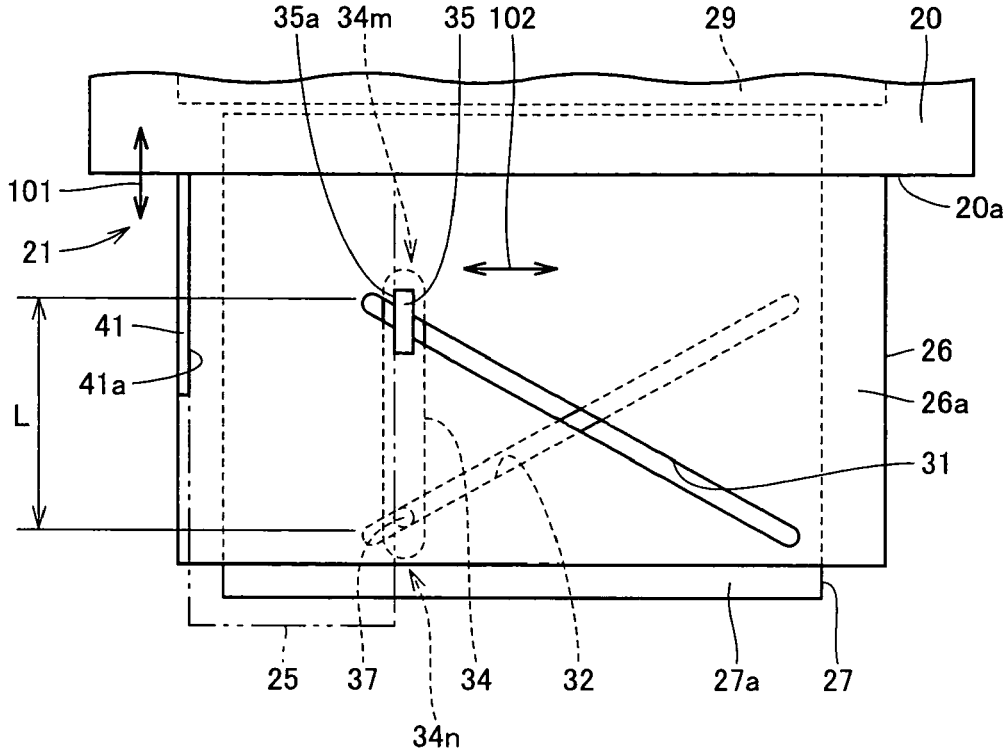
FIG. 6 is a top view showing the multipurpose tray in a second embodiment of the present invention.
Figure 7:
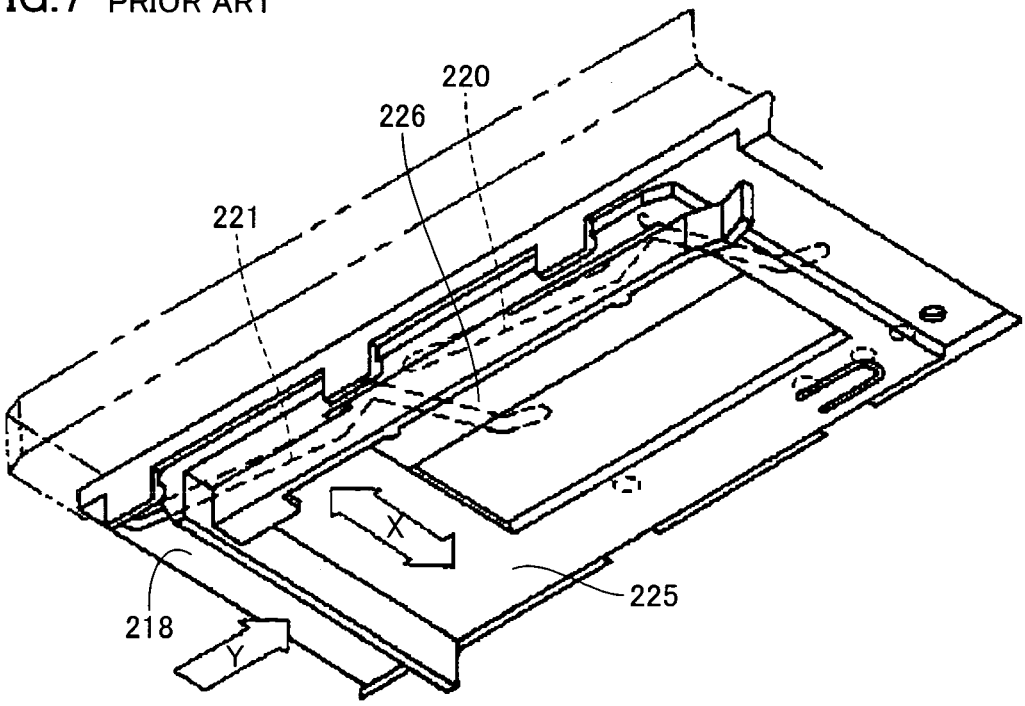
FIG.7 PRIOR ART
FIG. 7 is a perspective view showing a sheet cassette disclosed in Japanese Patent Laying-Open No. 07-242341.

FIG. 6 shows a multipurpose tray according to a second embodiment. FIG. 6 corresponds to FIG. 3 in the first embodiment, and the same reference numbers are used for members identical to or equivalent to those of the multipurpose tray shown in FIG. 3. The multipurpose tray in the present embodiment basically includes a similar configuration. In the following, description will not be repeated for the common configuration.

Referring to FIG. 6, in the multipurpose tray of the present embodiment, lever opening 31 extends to have an increased distance from sheet supplying part 29 as it becomes farther away from sheet abutting part 41, and lever opening 32 extends to have a decreased distance from sheet supplying part 29 as it becomes farther away from sheet abutting part 41. With this configuration, distance L between lever openings 31 and 32 is reduced as they are farther away from sheet abutting part 41 (it is to be noted that although there is a section where the positional relation of lever openings 31 and 32 in the sheet feeding direction reverses in FIG. 6, it is assumed that distance L takes a negative value in the section).

In the thus configured multipurpose tray in the second embodiment of the present invention, compared to multipurpose tray 21 of the first embodiment, the amount of change of distance L along the sheet width direction is larger. Accordingly, the amount of slide movement of tray 27 can be increased, although smoothness while the sheet pressing part 35 is moved is slightly impaired.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A multipurpose tray comprising:

a first tray having a first loading surface with a sheet loaded on said first loading surface being transported in a predetermined direction;

a second tray provided to be freely slidable along said predetermined direction with respect to said first tray and having a second loading surface with an area continuous to said first loading surface changing in accordance with slide movement of said second tray;

wherein said first tray is provided with a first lever opening penetrating said first loading surface, and said second tray is provided with a second lever opening with a changing distance from said first lever opening along a direction orthogonal to said predetermined direction, the multipurpose tray further comprising:

a lever having one end guided by said first lever opening and the other end guided by said second lever opening; and a sheet pressing part provided at said one end and regulating a sheet position along the direction orthogonal to said predetermined direction on said first loading surface;

wherein when said sheet pressing part is moved along said first lever opening in accordance with a sheet size, said second tray slides with respect to said first tray via said lever, wherein said first tray is provided with a sheet abutting part positioned opposite to said sheet pressing part with the sheet loaded on said first loading surface therebetween and where the sheet is abutted, and said first tray is connected to a sheet supplying part where the sheet is supplied from said first loading surface, wherein at positions equal in distance from said sheet abutting part in the direction orthogonal to said predetermined direction, one of said first and second lever openings includes a first part extending in the direction orthogonal to said predetermined direction, and wherein said first lever opening includes a second part extending to have an increased distance from said sheet supplying part as it becomes farther away from said sheet abutting part.

2. A multipurpose tray comprising:

a first tray having a first loading surface with a sheet loaded on said first loading surface being transported in a predetermined direction;

a second tray provided to be freely slidable along said predetermined direction with respect to said first tray and having a second loading surface with an area continuous to said first loading surface changing in accordance with slide movement of said second tray;

wherein said first tray is provided with a first lever opening penetrating said first loading surface, and said second tray is provided with a second lever opening with a changing distance from said first lever opening along a direction orthogonal to said predetermined direction, the multipurpose tray further comprising:

a lever having one end guided by said first lever opening and the other end guided by said second lever opening; and a sheet pressing part provided at said one end and regulating a sheet position along the direction orthogonal to said predetermined direction on said first loading surface;

wherein when said sheet pressing part is moved along said first lever opening in accordance with a sheet size, said second tray slides with respect to said first tray via said lever; and wherein at least one of said first lever opening and said second lever opening comprises an inclined part which makes an acute angle with said predetermined direction.

3. The multipurpose tray according to claim 2, wherein said first tray is provided with a sheet abutting part positioned opposite to said sheet pressing part with the sheet loaded on said first loading surface therebetween and where the sheet is abutted, and wherein at positions equal in distance from said sheet abutting part in the direction orthogonal to said predetermined direction, one of said first and second lever openings includes a first part extending in the direction orthogonal to said predetermined direction.

4. A multipurpose tray comprising:

a first tray having a first loading surface with a sheet loaded on said first loading surface being transported in a predetermined direction;

a second tray provided to be freely slidable along said predetermined direction with respect to said first tray and having a second loading surface with an area continuous to said first loading surface changing in accordance with slide movement of said second tray;

wherein said first tray is provided with a first lever opening penetrating said first loading surface, and said second tray is provided with a second lever opening with a changing distance from said first lever opening along a direction orthogonal to said predetermined direction, the multipurpose tray further comprising:

a lever having one end guided by said first lever opening and the other end guided by said second lever opening; and a sheet pressing part provided at said one end and regulating a sheet position along the direction orthogonal to said predetermined direction on said first loading surface;

wherein when said sheet pressing part is moved along said first lever opening in accordance with a sheet size, said second tray slides with respect to said first tray via said lever; and wherein said first tray is provided with a sheet abutting part positioned opposite to said sheet pressing part with the sheet loaded on said first loading surface therebetween and where the sheet is-abutted, and said first tray is connected to a sheet supplying part where the sheet is supplied from said first loading surface, and wherein said first lever opening includes a second part extending to have an increased distance from said sheet supplying part as it becomes farther away from said sheet abutting part.

* * * * *